United States Patent [19]

DiCello

[11] Patent Number: 4,538,386

[45] Date of Patent: Sep. 3, 1985

[54] DRAINAGE SYSTEM AND METHOD

[75] Inventor: Robert T. DiCello, Twinsburg, Ohio

[73] Assignee: Ohio State Home Services, Inc., Macedonia, Ohio

[21] Appl. No.: 646,837

[22] Filed: Sep. 4, 1984

[51] Int. Cl.[3] ..... L02D 27/00

[52] U.S. Cl. ..... 52/169.5; 52/742; 405/43

[58] Field of Search ..... 52/169.5, 169.14, 742; 405/50, 45, 43, 38, 36

[56] References Cited

U.S. PATENT DOCUMENTS

| | | | |
|---|---|---|---|
| 1,734,777 | 11/1929 | Pike | 52/169.14 |
| 2,050,798 | 8/1936 | Kothe | 405/50 |
| 3,283,460 | 11/1966 | Patrick | 52/169.5 |
| 3,668,829 | 6/1972 | Nelson | 52/169.5 |
| 3,852,925 | 12/1974 | Gazzo | 52/169.5 |
| 4,075,800 | 2/1978 | Molick | 52/169.5 |
| 4,333,281 | 6/1982 | Scarfore | 52/169.5 |

FOREIGN PATENT DOCUMENTS

| | | | |
|---|---|---|---|
| 502359 | 11/1954 | Italy | 405/50 |

OTHER PUBLICATIONS

Dry Basements: How to Build Them; American Builder, pp. 60,61, ©Apr. 1963.

Ideas in Action; American Builder; p. 11, ©Jan. 1960.

*Primary Examiner*—Henry E. Raduazo

*Attorney, Agent, or Firm*—Yount & Tarolli

[57] ABSTRACT

A drainage system for draining water away from a building having a horizontal base and walls extending vertically from the base. The drainage system includes first drain means located in a first trench provided in the ground beneath the base inside the perimeter thereof. The first trench extends around the perimeter of the base and inside of the vertically extending walls. Second drain means is located in a second trench provided in the ground adjacent the ground surface and adjacent the perimeter of the horizontal base. The second trench extends around the perimeter of the horizontal base and outside of the vertically extending walls. A gravel filling is provided in the first and second trenches and covers at least partially the first and second drain tiles.

15 Claims, 4 Drawing Figures

DRAINAGE SYSTEM AND METHOD

BACKGROUND OF THE INVENTION

The present invention relates to a system and method for preventing water from seeping into a building, and in particular relates to a drainage system for a building.

The seepage of water into a building has been a problem which constantly plagues the construction industry. This has been a problem for buildings which have basements as well as buildings on a slab. In particular, the seepage problem has plagued buildings having a below ground foundation wall.

It is known that the foundation wall of a building is most often made from hollow concrete blocks, and water is able to pass from the exterior surrounding ground of the building through cracks, holes, natural pores, etc. in the block into hollow cavities of the block and thence to the basement floor. Even if the foundation wall is made from solid blocks or poured concrete, water may seep into the basement through cracks and by capillary action.

Numerous drainage systems and methods have been developed. In one known system drain tiles having holes therein for receiving water are located around the outside perimeter of a building such as around the outside perimeter of the basement floor and in a deep trench at or below the level of the footer. The drain tiles form a pipe line which directs water to a storm or sanitary sewer. After a period of time, the drain tiles become non-functioning due to collapsing, blockage separation, etc., and water accumulates at the bottom of the foundation wall, with a resultant build-up of hydrostatic pressure. This water then seeps through cracks, holes, pores, etc. in the foundation wall and into the basement. To correct this problem, the drain tile must be replaced. However, replacement of a non-functioning tile is a very cumbersome operation which requires digging a trench along the foundation wall. This is not only troublesome, it can cause shifting of the building and structural damage. Further, digging a trench requires a backhoe, operation of which would damage the adjacent lawn, etc. This is an extremely costly operation. Also, such drain tiles located outside the perimeter of the basement do not effectively handle water buildup beneath the basement floor.

Another system is disclosed in U.S. Pat. No. 3,287,866. U.S. Pat. No. 3,287,866 discloses a system in which a trench is formed along the inside of a foundation wall next to the footer and beneath the basement floor or the like. Perforated drain tiles are placed in the trench and form a pipe line which directs water to a storm or sanitary sewer. The drain tiles are surrounded by gravel. Drainage openings are provided in the bottom portion of the foundation wall beneath the basement floor. The water flows through these openings into the gravel and to the drain tile from which the water flows into a sewer. Such a system relies on the water to drain downwardly through the concrete blocks. If the blocks have cracks in the interior of the foundation wall, the water will sweep through such cracks. Thus, this system is not particularly effective.

To eliminate or reduce seepage of the water through cracks between the foundation wall and the basement floor, an expansion plate has been used. As the basement floor contracts such as upon solidifying, the expansion plate expands taking up the space between the foundation wall and the floor. Use of such an expansion plate is disclosed in U.S. Pat. No. 3,850,193.

The object of the present invention is to provide a system which minimizes the above-identified problems in the prior art and specifically (i) handles water buildup beneath the building, (ii) minimizes seepage of water through the block into the building interior above the basement floor, (iii) eliminates the need to dig a deep trench adjacent a foundation wall and the attendant problems, and (iv) is safer to install.

SUMMARY OF THE INVENTION

The present invention may be applied to different types of building structures, for example, ones having a below ground poured concrete foundation, a below ground concrete block foundation, or even those built on a slab. The system of the present invention is extremely effective in minimizing seepage of water into a building. The objects of the invention are achieved by providing a trench in the ground adjacent the ground surface and adjacent the perimeter of a building and outside of the building walls and placing drain tiles in this trench. The trench is dug at an angle to the horizontal to provide for flow of water in the tile. The trench has a depth of at least 18 to 24 inches at its shallow end, and a width of at least 14 inches and preferably 18 inches. Preferably, the trench depth does not exceed about three (3) feet. Thus, cumbersome deep excavation is unnecessary. The trench may be dug manually and it is unnecessary for a workman to work in a deep, narrow trench. A plastic sheet is placed in the trench to line the trench and form a trough. Then a layer of gravel is placed in the trough, drain tiles are placed on that gravel, adhered together, and the trough is filled with gravel. A perforated sheet of plastic is then placed over the gravel to prevent dirt from settling down through the gravel. Because of the perforated plastic sheet and gravel, dirt is not readily able to penetrate and clog the drain tile. Also, this arrangement blocks water from contact with the building base such as a slab or a foundation wall. A trench extending beneath the building base inside the perimeter thereof and inside of the building walls with drain tiles located in this trench provides for drainage of water which may build up beneath the base.

The walls, especially foundation walls, when made from hollow blocks, may have openings or weep holes at the bottom thereof to facilitate water flow to the inside drain tiles. The water flows through the openings to the drain tiles and therefrom to a storm sewer system.

The tiles located in the shallow trench outside the building provide for drainage of almost all surface water. Thus, only a very small amount of water, if any, penetrates into the foundation wall, which water is drained away by the inside tiles. The inside tiles also handle water buildup beneath the building.

An expansion plate may be placed between the base and the building walls when foundation walls are used. The plate takes up the space, which may be formed between the walls and the base block when the latter contracts, and prevents seepage of water between the wall and the base. The expansion plate also serves as a conduit for conducting water from the openings in the wall into the inside tiles. The expansion plate also keeps these weep holes free of gravel or concrete that could block them.

The drain tiles outside and inside the walls may be connected to sump pumps, which pump the water into a storm sewer system.

The drainage system of the invention operates as follows. Surface waters outside a building flow into the plastic trough, the gravel, and through openings in the drain tile into the interior of the drain tile located outside the building. This water flows through the drain tile into the storm sewer system. These drain tiles carry away almost all surface water in the area adjacent the building. The small amount of water that may penetrate the building wall and may build up from beneath the building base flows into the drain tile located beneath the base. This water flows through the drain tile and is pumped by a sump pump into the storm sewer system.

BRIEF DESCRIPTION OF THE DRAWINGS

The above mentioned and other features and objects of this invention and the manner of attaining them will become more apparent and the invention itself will be best understood by reference to the following description of the invention taken in conjunction with the accompanying drawings wherein.

DESCRIPTION OF THE PREFERRED EMBODIMENT

Figure 1:
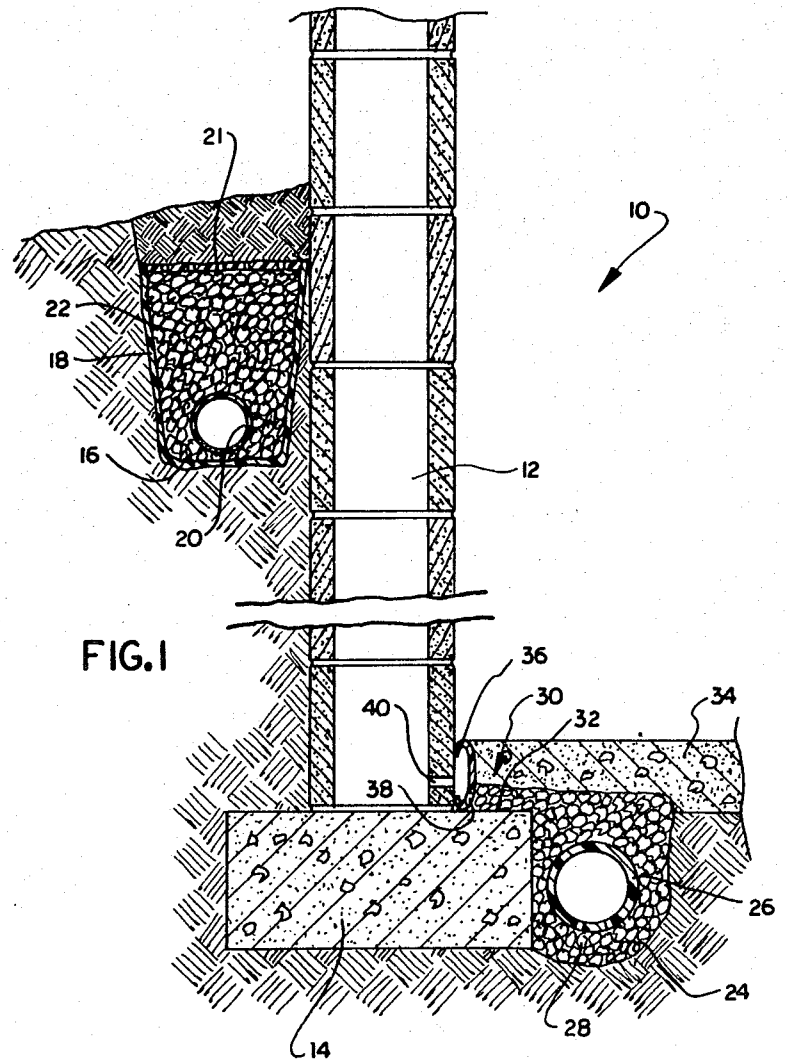
FIG. 1 is a vertical section of a portion of a building having a below ground foundation wall and the drainage system of the present invention applied thereto.
Figure 3:
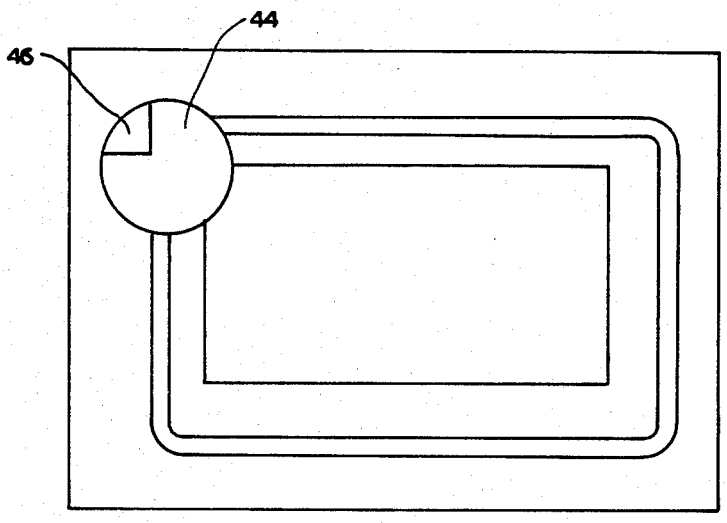
FIG. 3 is a diagram showing the connection of drain tile to a sump pump.
Figure 4:
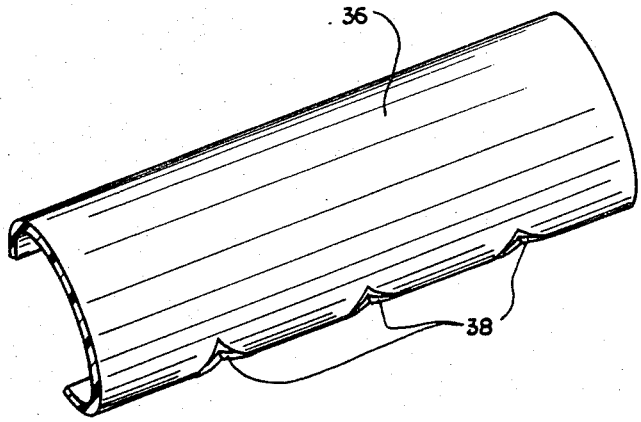
FIG. 4 is a perspective view of an expansion plate used in the system.

With reference to FIG. 1, reference numeral 10 generally designates a drainage system embodying the present invention. A foundation wall 12 is supported on a footer 14. An outside trench 16 is excavated to a shallow depth beneath the ground level next to the outside surface of the wall 12. Preferably, the trench is not less than 18 inches deep, not less than 14 inches wide, and not greater than about three feet deep. A plastic sheet 18 is placed in the trench 16 to form a trough. Then a layer of gravel is placed in the trough to form a bed. The sheet is preferably made of a polyvinyl chloride material. The sheet is preferably visqueen.

Means for draining water is placed in the trough. This means is drain tile 20. The drain tile may take a variety of forms, for example, the drain tile may be corrugated perforated flexible pipe, plastic perforated pipe sections, etc. If pipe sections are used, the individual pipe sections or drain tiles 20 are placed in the trough and secured together by a suitable adhesive to form a pipe line.

After the drain tile 20 is placed in the trough, the trough is filled with gravel 22. The gravel is preferably a washed river bed gravel size #57. The gravel size is large enough that it does not clog the openings in the drain tile. The gravel protects the tile from dirt and allows water to flow therethrough to the tile. The gravel 22 may be covered by the perforated plastic sheet 21 preferably having 18 holes per square foot, and the trench may be back filled with earth.

An inside trench 24 is formed inside of the wall 12 next to the footer 14. A gravel bed is layed and drain tile 26 is placed in the inside trench 24. These tiles, if individual pipe sections, are secured together by a suitable adhesive to form a pipe line. The respective pipe lines formed by the drain tiles 20 and 26 are inclined to the horizontal to provide for free flow of water through the lines.

The drain tiles 26 are also covered with the gravel 28. The gravel fills the trench 24 and forms a layer on the portion 30 of the top surface 32 of the footer 14 which is located inside the foundation wall 12. The top layer of the gravel is then covered with cement forming the basement floor 34.

An expansion plate 36 is mounted between the foundation wall 12 and adjacent the end of the basement floor 34. The expansion plate 36 extends from the top surface of the footer 14 to the top surface of the floor 34. The expansion plate 36 may have, preferably an arcuate cross section and is provided at the bottom portion thereof with notches 38 for conducting water which flows through weep holes 40 in the bottom of the foundation wall 12 into the gravel.

Figure 2:
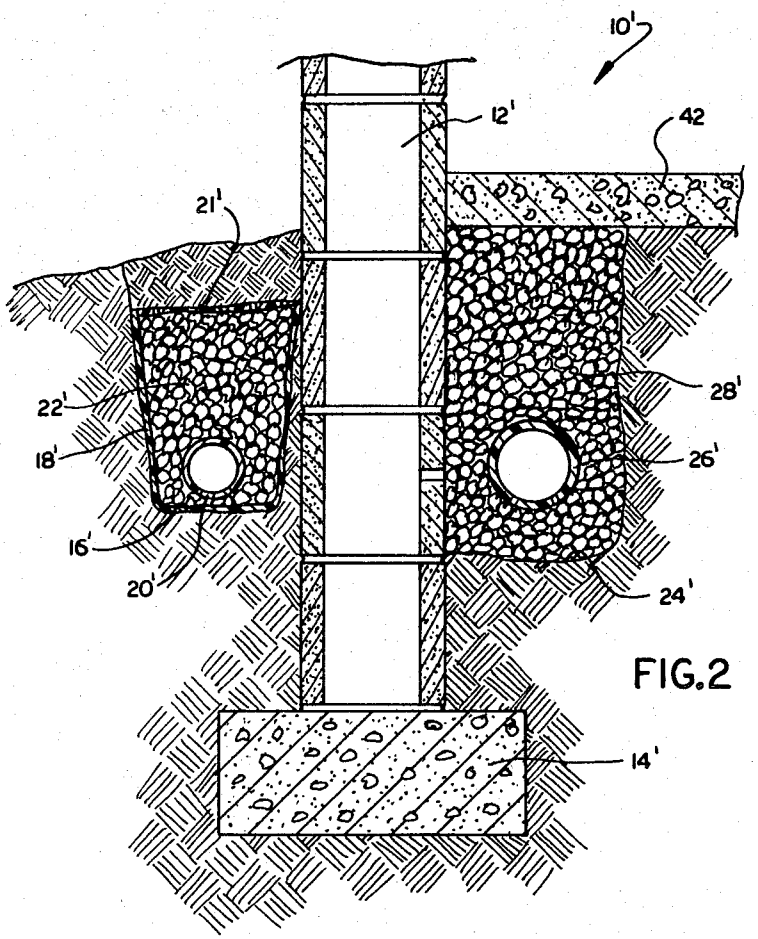
FIG. 2 is a vertical section of a building of a slab-type construction and the drainage system of the invention.

FIG. 2 shows a drainage system for a building of a slab-type construction. In FIG. 2, the corresponding elements are designated with the same reference numerals as in FIG. 1 with a prime added.

FIG. 2 shows a wall 12' supported on a footer 14'. Outside and inside trenches 16' and 24' are provided at approximately the same level and below the slab 42. Drain tiles 20' and 26' are placed in the trenches 16' and 24', respectively, in a manner discussed above.

A reservoir or pit may be provided at one corner of the building if necessary, and the drain tile directs water into the pit. The pit is generally 18 inches in diameter and 30 inches deep. However, a less deep pit may be used. The pit is usually lined with tile, concrete, plastic, or metal (steel). The sump pump 46 pumps water from the pit 44 into the sewer system (not shown).

The method of providing storm drainage of a building is clear from the foregoing description of the drainage system. Nevertheless, it will now be described in more detail.

The trench 16 is at least about 14 inches wide and 18 inches deep and not greater than about three feet deep. The portion of the foundation wall which defines the trench should be, preferably, cleaned of any dirt, and a strip of tar of approximately 6 inches wide is applied to the wall just below the ground level. The plastic sheet 18 is attached at one end to the tar and is shaped to form a trough. The sheet 18 is thus secured to the outside of the foundation wall and blocks water flow along the foundation wall. Preferably, the trench is dug 14–18 inches wide and 18–24 inches deep. It is dug adjacent the other side of the building wall and around the perimeter of the building. The trench extends at an angle to the horizontal to provide for water flow in the drain tile. Then a layer of gravel is placed in the trough, perforated drain tiles are placed on that gravel, adhered together and the trough is then filled with gravel. Preferably, the gravel should be preliminarily washed. The perforated plastic sheet may be placed over the gravel and back-filled with earth.

The inside drain is formed on an existing building by using a jack hammer or the like to break up the slab 42 on the perimeter interior of the building. The trench 24' is then dug, a gravel base layed, the drain tile is positioned in the trench and the trench is filled with gravel. Also, before filling the trench with gravel, openings or weep holes are drilled in the foundation wall below the floor level. When applying the system to a building of a slab-type construction, both trenches 16' and 24' are formed at substantially the same level below the ground.

The drain tiles 20 or 20' located outside the building in combination with the ground and plastic trough provide an effective means of draining surface water away from the building and preventing the water from penetrating into the interior of the foundation wall. Any water that penetrates into the foundation wall is drained away by the tiles 26 or 26' located beneath the building base. Also, the tiles 26 or 26' will drain water which builds up beneath the building base.

While the invention has been described herein in terms of the preferred embodiment, numerous variations may be made therein without departing from the scope and the spirit of the invention as defined in the appended claims.

I claim:

1. A drainage system for draining water away from a building located in ground having a surface above which a portion of the building extends, the building having a horizontal base lying adjacent the ground and walls extending vertically from said base, said system including first drain means located in a first trench provided in the ground beneath said base adjacent the perimeter thereof, said first trench extending around at least a portion of the perimeter of said base and inside of said vertically extending walls, second drain means located in a second trench provided in the ground, said first and second drain means being independent of each other whereby said second drain means does not communicate with said first drain means, said second trench extending around at least a portion of the perimeter of said walls and outside of said vertically extending walls, said second trench being at least about 14 inches wide and about 18 inches deep and not greater than about three feet deep, said base being substantially deeper in the ground than said second drain means, said second trench being lined with a plastic sheet to form a trough for capturing water flowing from the ground surface into said second trench and for preventing water from flowing downwardly along said walls, said second drain means comprising pipe means for receiving water captured in said trough and for conducting said water away from said building, and gravel filling said first and second trenches and covering at least partially said first and second drain means.

2. A drainage system as defined in claim 1, further comprising means for securing said plastic sheet to the exterior of said building walls at approximately the surface of the ground.

3. A system as set forth in claim 2 further comprising a footer and wherein said vertically extending walls are foundation walls supported on said footer, said first trench is provided adjacent said footer and said second trench is provided in the ground above said footer.

4. A drainage system as set forth in claim 2, wherein said plastic sheet is a polyvinyl chloride material.

5. A drainage system as set forth in claim 1 wherein said first and second drain means comprise perforated plastic tubes.

6. A drainage system as set forth in claim 1 wherein said foundation walls are formed of hollow building blocks and provided with openings in the bottom portion thereof for conducting moisture that penetrates inside of the blocks to said first trench.

7. A drainage system as set forth in claim 3 further including an expansion plate located between the inside surface of said foundation wall and a side end surface of the base adjacent said foundation walls, said expansion plate being supported on the surface of said footer and extending between the top surface of said footer and the top surface of the base, said expansion plate having notches formed in the lower portion thereof for conducting water therethrough to said first trench, the gravel in said first trench engaging portions of said expansion plate above the level of said notches.

8. A drainage system as set forth in claim 7 wherein said expansion plate has an arcuate cross section.

9. A drainage system as set forth in claim 1 wherein said gravel is a washed river bed gravel size 57.

10. A drainage system as set forth in claim 2 wherein said gravel is a washed river bed gravel size 57.

11. A drainage system for draining water away from a building located in ground having a surface above which a portion of the building extends, the building having a horizontal base lying adjacent the ground and walls extending vertically from said base, said system including first drain means located in a first trench provided in the ground beneath said base adjacent the perimeter thereof, said first trench extending around at least a portion of the perimeter of said base and inside of said vertically extending walls, second drain means located in a second trench provided in the ground, said first and second drain means being independent of each other whereby said second drain means does not communicate with said first drain means, said second trench extending around at least a portion of the perimeter of said base and outside of said vertically extending walls, said second trench being at least about 14 inches wide and about 18 inches deep and not greater than about three feet deep, said base being substantially deeper in the ground than said second drain means, said second drain means comprising pipe means for receiving water and for conducting said water away from said building, and gravel filling said first and second trenches and covering at leat partially said first and second drain means.

12. A drainage system for draining water away from a building located in ground having a surface above which a portion of the building extends, the building having a horizontal base lying adjacent the ground and walls extending vertically from said base, said system including first drain means located in a first trench provided in the ground beneath said base adjacent the perimeter thereof, said first trench extending around at least a portion of the perimeter of said base and inside of said vertically extending walls, second drain means located in a second trench provided in the ground, said second trench extending around at least a portion of the perimeter of said walls and outside of said vertically extending walls, said second trench being at least about 14 inches wide and about 18 inches deep and not greater than about three feet deep, said second trench being lined with a plastic sheet to form a trough for capturing water flowing from the ground surface into said second trench and for preventing water from flowing downwardly along said walls, said plastic sheet being secured to the exterior of said walls at approximately the level of the surface of the ground, said second drain means comprising pipe means for receiving water captured in said trough and for conducting said water away from said building, gravel filling said first and second trenches and covering at least partially said first and second drain means, said walls being formed of hollow building blocks and provided with openings in the bottom portion thereof for conducting moisture that penetrates inside of said blocks to said first trench, said drainage system further including an expansion plate located between the inside surface of said wall and a side end surface of the base adjacent said walls, said expansion plate having notches formed in the lower portion thereof for conducting water therethrough to said first trench, said gravel in said first trench engaging portions of said expansion plate above the level of said notches, and a perforated plastic sheet covering said gravel in said second trench.

13. A method of draining water away from a building in ground having a surface above which a portion of the building extends, the building having a horizontal base lying adjacent the ground and walls extending vertically therefrom, said method including the steps of:

providing a first trench in the ground beneath said base adjacent the perimeter thereof and extending around said perimeter and inside of said walls, placing first drain means in said first trench, providing a second trench in the ground at least about 14 inches wide and about 18 inches deep and not greater than about three feet deep and outside of said walls, placing second drain means in said second trench substantially above the level of said base, said first and second drain means being independent of each other whereby said second drain means does not communicate with said first drain means, and filling said first and second trenches with gravel.

14. A method as set forth in claim 13 further including the steps of:

forming a trough of a plastic sheet in said second trench, and placing said second drain means in said trough.

15. A method as set forth in claim 13 wherein said walls are formed of hollow building blocks, and further including the step of providing openings in the bottom portion of said walls to allow water to drain into said first trench.

* * * * *